United States Patent [19]

Lucas

[11] 4,106,143

[45] Aug. 15, 1978

[54] KNEE BRACE

[76] Inventor: Gareth Douglas Lucas, Lower House Farm, Llantwit Major, Glamorgan, Wales

[21] Appl. No.: 813,853

[22] Filed: Jul. 8, 1977

[30] Foreign Application Priority Data

Jul. 8, 1976 [GB] United Kingdom ..... 28482/76

[51] Int. Cl.[2] ..... B63B 29/00

[52] U.S. Cl. ..... 9/1.7; 9/7; 9/1.4

[58] Field of Search ..... 9/1.1, 1.4, 1.6, 1.7, 9/6 R, 7; 297/384, 390; 296/63

[56] References Cited

U.S. PATENT DOCUMENTS

| | | | |
|---|---|---|---|
| 2,286,350 | 6/1942 | Drake | 9/1.1 |
| 3,031,229 | 4/1962 | Symbaluk | 297/390 |
| 3,165,333 | 1/1965 | Dalgeish | 297/390 |
| 3,279,817 | 10/1966 | Henry | 297/390 |
| 3,627,073 | 12/1971 | Grimm | 296/63 |
| 3,769,647 | 11/1973 | Basa | 9/400 |
| 4,031,580 | 6/1977 | Neumann | 9/1.4 |

*Primary Examiner*—Trygve M. Blix
*Assistant Examiner*—D. W. Keen
*Attorney, Agent, or Firm*—Owen, Wickersham & Erickson

[57] ABSTRACT

The invention relates to a brace which is mountable in or on, or is formed integral with, a craft such as a canoe, kayak, surf-ski or skiff so that it can in use contact and receive thrust from the thigh of a user of the craft so that the user can propel the craft more easily and can prevent himself from falling from the craft.

3 Claims, 5 Drawing Figures

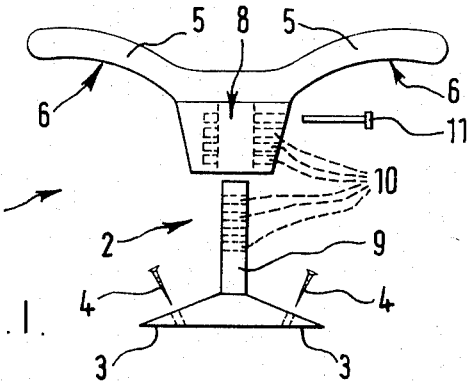
FIG. 1.
FIG. 2.
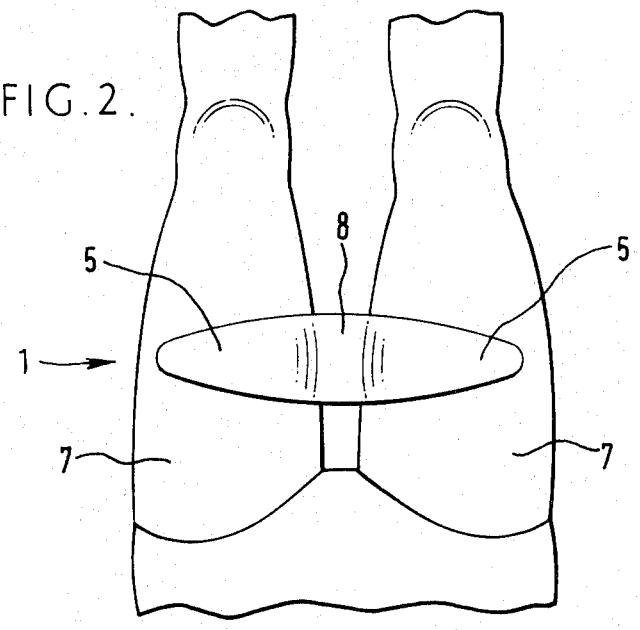

KNEE BRACE

The invention relates to a brace for a craft such as a canoe, surf-ski, or skiff. The invention also relates to such a craft including a brace.

Known surf-skis are principally used for life-saving in big surf though they can be used for leisure and competition. Originally such craft were flat-bottomed and were barge-like. Nowadays, the tendency is for them to be shaped more like a kayak, and indeed recent design is based a great deal on racing kayak configuration. At present Australian and South African designs are based on the Kayak classes K1 and K2 for competition. U.S.A. practice tends to influence smaller surf-skis for the patrol work aspect of life-saving, and for pleasure surfing.

All purpose canoes, surf-skis, or skiffs have the disadvantage that they are difficult to ride in surf or broken water.

It is accordingly an object of the invention to seek to mitigate this disadvantage of known craft.

According to one aspect, the invention provides a brace for bracing a leg of a user of a craft such as a canoe, surf-ski, or skiff, comprising a support for mounting on the craft and a brace member which projects laterally from the support for receiving, in use, thrust from a leg of a user of the craft during propulsion of the craft.

According to a second aspect, the invention provides a craft such as a canoe, surf-ski or skiff, or to a cockpit for such a craft, the craft cockpit hving a seat for a user and a brace so disposed in relation to the seat that it can receive thrust from a thigh of a user of the craft in use.

The brace may comprise a support projecting upwardly from part of the craft, for example from a cockpit thereof, which support has a brace member projecting laterally from it for receiving the thrust.

There may be two brace members which may each project laterally from the support on each side of the support.

The brace members may be at the end of the support remote from an end which is securable to a craft.

Each brace member may have a surface configuration which is substantially complementary to the shape of the upper or forward surface of a thigh of a user.

The support may comprise feet adapted to receive securing means for securing the brace to the craft.

The support may comprise two telescopic parts each of which has a series of holes which can be aligned and which can receive a pin, peg or bolt for securing one part with respect to the other so that the brace has a desired length.

The craft may be moulded in plastics material and the brace may be integrally formed in the moulding process.

Constructions embodying the invention are diagrammatically illustrated, by way of example, in the accompanying drawings, in which:

FIG. 1 shows an exploded end view of a leg brace;

FIG. 2 shows a top plan view of the brace in use;

Figure 3:
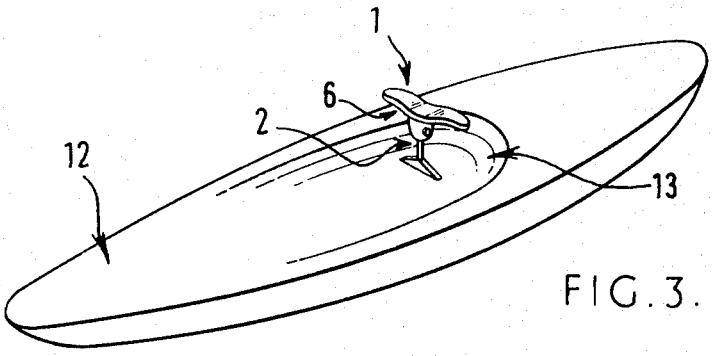
FIG. 3 shows a perspective view of a glass reinforced plastics canoe having the brace of FIG. 1 and FIG. 2 in position.

Referring firstly to FIGS. 1 to 3 of the drawings, there is shown a leg brace 1. The brace comprises a support 2 which has feet 3 by which it can be fixed to a craft by fixing means such as screws 4. There is, at the other end of the support, a pair of laterally extending brace members 5 which form a kind of cross-tree. Each brace member 5 has an under surface 6 (as viewed in FIG. 1) which has a curve for comfortable engagement with the upper part (in use) of a thigh 7 of a user.

The brace members 5 are integral with a post part or head 8 of the support which engages telescopically with a post part 9 projecting upwardly from the feet 3 of the support. Both post parts have holes 10 so that two holes can be aligned when one part is slidden relative to the other and can then receive a bolt 11. In this way the brace 1 can be adjusted in length so that the brace members 5 are a suitable comfortable distance from a floor of a cockpit or deck of the craft, for receiving the leg of a particular user.

In use, the brace 1 is secured by the screws 4 to a craft 12 (FIG. 3) at a position in its cockpit 13 where the support will be between the legs of a user and so that the brace members will project over the thighs of a user. The height is adjusted so that when a user propels the craft his thighs thrust against the undersurfaces 6 of the brace members 5 and so provide a unity of thrust between the user and the craft. This is particularly important for providing good propulsion and control in slalom canoes and surf-skis, and for helping the user to prevent himself from falling from the craft.

Figure 4:
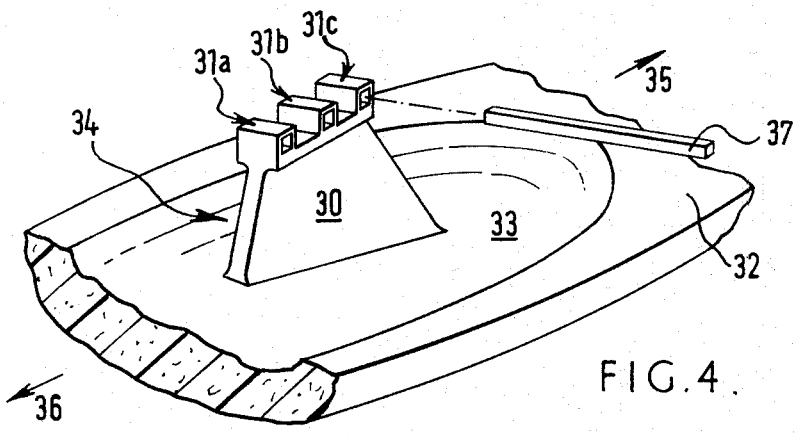
FIG. 4 shows a perspective view of a canoe with another embodiment of brace.

Referring now to FIG. 4, the cockpit 33 of the canoe 32 (part of which only is shown), has a brace 34 integrally moulded with the canoe and consisting of a support 30 which terminates at its upper end (as viewed) in a number, in this case three, of transversely arranged seating mountings or channels 31*a*, 31*b*, 31*c* which extend transversely of the fore 35 and aft 36 direction of the canoe 32.

An elongate member such as an aluminium rod 37 of the same section as each channel 31*a*, 31*b*, 31*c* can be slid into one channel e.g. channel 31*c* so that projecting ends of the rod provide the bracing members. The rod 37 can be inserted in a particular channel depending on the length of thigh of a user of the craft to give a comfortable a position of the bracing members for that particular user as possible.

Figure 5:
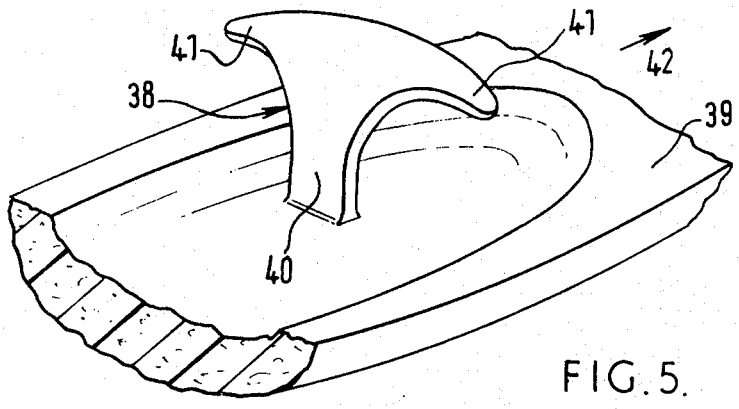
FIG. 5 shows a further canoe with a third embodiment of brace.

Referring now to FIG. 5, the brace 38 shown there is not adjustable either for height (as in FIGS. 1 to 3) or for longitudinal position fore and aft of the canoe 39 (FIG. 4). The brace 38 is moulded integrally with the canoe 39, in its cockpit 40 in glass fibre reinforced plastics (like in FIG. 4) and consists of a support 40 which leads into integral lateral extensions or wings 41 forming the bracing members. The upper part of the brace is open in a direction facing aft 42. The brace 38 can therefore be used as a handle when the fingers are inserted in the open part and grip round the aft edge. When the hand gripping the brace is raised, the whole craft 39 can be lifted and thus carried, because as will be understood such a craft is light in weight.

The brace may be made as by moulding from polypropylene and glass tissue.

It will be understood that where a craft such as a slalom canoe or a surf-ski is made by moulding, the brace can be incorporated in the moulding step so that it becomes an integral part of the craft.

The invention described with respect to the drawings can be modified in many ways. For example, the braces of FIGS. 4 and 5 may be made separately and may have feet so that they can be mounted in a craft. Also, the brace members may include padding, such as plastics foam padding. Also, the craft can include speed boats in which it is often necessary for an occupant to thrust against part of the craft in order to stay aboard, particularly in rough conditions.

I claim:

1. A surf-ski wherein there is a hull, a deck secured to the hull, a cockpit area in the deck and brace means, said brace means projecting from said cockpit generally amidships of said surf-ski and comprising support means integral with said surf-ski, brace members projecting laterally of said support means at a position spaced above said cockpit at a height such that said brace members can be gripped by the upper surfaces of the thighs of a user of said surf-ski to transmit thrust of the user into the brace means during propulsion of the surf-ski, and means for adjusting the position of said brace members relative to said surf-ski.

2. The surf-ski of claim 1, wherein said support means comprises a first part projecting upwardly from said cockpit and a second part telescopically mounted thereon and carrying said brace members, and wherein said adjusting means comprises a series of holes in one of the parts and at least one alignable hole in the other part, and means for engaging aligned holes of the first and second parts for holding said second part at a desired vertical position with respect to the first part and the cockpit.

3. The surf-ski of claim 1, wherein said adjusting means includes a plurality of separate channels, the axis of each channel extending through said support member in a direction transverse to the fore and aft axis of the surf-ski, the channels being arranged along said fore and aft axis, the brace members being removably mountable in any of the channels for adjusting the fore and aft position of the brace members.

* * * * *